US007727090B2

(12) United States Patent
Gant

(10) Patent No.: US 7,727,090 B2
(45) Date of Patent: Jun. 1, 2010

(54) TRAINING BAT WITH VISUAL FEEDBACK OF PROPER SWING

(75) Inventor: Richard Alva Gant, 1740 Alta Vista Way, San Diego, CA (US) 92109

(73) Assignee: Richard Alva Gant, San Diego, CA (US)

( * ) Notice: Subject to any disclaimer, the term of this patent is extended or adjusted under 35 U.S.C. 154(b) by 269 days.

(21) Appl. No.: 12/053,824

(22) Filed: Mar. 24, 2008

(65) Prior Publication Data

US 2008/0305895 A1 Dec. 11, 2008

Related U.S. Application Data

(60) Provisional application No. 60/942,055, filed on Jun. 5, 2007.

(51) Int. Cl.
*A63B 69/00* (2006.01)

(52) U.S. Cl. ..... 473/453; 473/233; 473/457

(58) Field of Classification Search ..... 473/234, 473/451, 453, 233, 219, 220, 422; 73/493
See application file for complete search history.

(56) References Cited

U.S. PATENT DOCUMENTS

| | | | | |
|---|---|---|---|---|
| 2,780,098 | A | 2/1957 | Maroth | |
| 3,137,504 | A * | 6/1964 | Zordan et al. | 473/457 |
| 4,267,793 | A * | 5/1981 | Lane et al. | 116/324 |
| 4,274,631 | A | 6/1981 | Hayazaki | |
| 4,759,219 | A * | 7/1988 | Cobb et al. | 73/493 |
| 4,834,376 | A * | 5/1989 | Steinberg | 473/457 |
| 4,871,168 | A | 10/1989 | Autorino et al. | |
| 4,953,868 | A | 9/1990 | Thompson et al. | |
| 5,056,783 | A | 10/1991 | Matcovich et al. | |
| 5,082,283 | A * | 1/1992 | Conley et al. | 473/234 |
| 5,590,875 | A * | 1/1997 | Young | 473/457 |
| 5,775,800 | A | 7/1998 | Hsieh | |
| 5,841,029 | A * | 11/1998 | Luking | 73/514.31 |
| 6,173,610 | B1 * | 1/2001 | Pace | 73/493 |
| 6,193,620 | B1 * | 2/2001 | Tarng | 473/465 |
| 6,220,719 | B1 | 4/2001 | Vetorino et al. | |
| 6,569,042 | B2 * | 5/2003 | LaChance et al. | 473/457 |
| 6,770,002 | B2 | 8/2004 | Aigotti | |
| 6,812,583 | B2 | 11/2004 | Cheung et al. | |
| 6,830,520 | B1 * | 12/2004 | Bollar | 473/457 |
| 7,014,580 | B2 | 3/2006 | Forsythe et al. | |
| 7,056,240 | B2 | 6/2006 | Brock et al. | |
| 7,147,580 | B2 | 12/2006 | Nutter et al. | |
| 7,229,188 | B2 | 6/2007 | Mah | |

* cited by examiner

*Primary Examiner*—Gene Kim
*Assistant Examiner*—M Chambers
(74) *Attorney, Agent, or Firm*—John L. Rogitz

(57) ABSTRACT

A training baseball bat has an internal movable magnet that accelerates to the end of the bat when swung at a fast enough speed. As the magnet moves it passes through a coil that is connected to one or more LEDs so that the LEDs momentarily flash as the magnet moves through the coil. A stationary magnet can be used to hold the movable magnet until sufficient centrifugal force is imparted by the swing to overcome the magnetic holding force. Spacers can be provided to establish a distance between the magnets as needed to establish a desired swing speed at which centrifugal force overcomes the magnetic attraction.

19 Claims, 2 Drawing Sheets

TRAINING BAT WITH VISUAL FEEDBACK OF PROPER SWING

This application claims priority to U.S. provisional patent application 60/942,055, filed Jun. 5, 2007, incorporated herein by reference.

I. FIELD OF THE INVENTION

The present invention relates generally to baseball bats used for training purposes.

II. BACKGROUND OF THE INVENTION

A properly executed baseball swing is a difficult skill to learn, because while swing mechanics can be told to a batter, the muscle coordination necessary to execute a superior swing is dauntingly complex. First, to impart optimum power the bat should be swung in an optimum swing plane that is substantially horizontal, i.e., it ideally exhibits a slight uppercut a few degrees from horizontal, although depending on ball location, other swing planes may be used.

But not only must the bat swing follow a preferred swing plane, the speed of the bat head should be at an acceptably high magnitude at a particular point in the plane, namely, the point at which contact with the ball is made. While exceptions may be made by skilled batters depending on special circumstances, e.g., in an effort to hit to the opposite field, the generally accepted optimal contact point is just in front of the batter toward the pitcher, typically where the swing plane intersects a vertical line extending from just in front of home plate.

The muscular coordination is further complicated by the fact that the head and shoulders must cooperate with the torso and hips to accelerate the bat through the contact point while maintaining the focus of the eyes on the ball at the point of contact. Allowing the shoulders to open prematurely, i.e., allowing the lead shoulder to swing toward the foul line too early in the swing, results in less power and missed pitches as the head and eyes are jerked from where focus should be, while leaving the shoulders closed too long results in less power in the swing.

SUMMARY OF THE INVENTION

A baseball training bat has a handle and a barrel formed with a channel from the end of the barrel, extending toward the handle. A stationary magnet is affixed within the channel, and a movable magnet is disposed in the channel for translational movement between a housed position, wherein the movable magnet is adjacent the stationary magnet and wherein magnetic attraction holds the movable magnet in the housed position, and a swung position, toward which the movable magnet moves when sufficient centrifugal force is imparted to the movable magnet to overcome the magnetic attraction between the magnets. A wire coil surrounds the channel and the movable magnet moves through the coil when the movable magnet moves from the housed position to the swung position. When the magnet moves through the coil, a temporary electrical signal is induced in the coil. One or more light emitting diodes (LED) are mounted on the barrel and are visible to a person swinging the bat. The LED are electrically connected to the coil to emit a flash of light in response to the movable magnet moving rapidly from the housed position to the swung position as a batter swings the bat. The bat contains no source of electrical power apart from the electrical power generated by the movable magnet moving through the coil.

In non-limiting implementations the stationary magnet is held in the channel by epoxy. One or more non-magnetic spacers may be disposed between the magnets, and the spacer defines a thickness in the dimension of the long axis of the bat. The thickness is established such that centrifugal force overcomes magnetic attraction between the magnets to move the movable magnet when the bat is swung at least as fast as a desired bat speed.

If desired, a tube may be disposed in the channel to hold the movable magnet and, if desired, the spacer. A cap can be engaged with the end of the barrel. The cap can hold a shock absorbing pad contacted by the movable magnet when the movable magnet reaches the swung position to generate audible and tactile feedback signals thereof to a person swinging the bat.

In another aspect, a baseball training device includes an elongated barrel swingable in an arc by a person. Visible indication is provided on the barrel of the barrel being swung at or greater than an acceptable speed as it passes through an imaginary vertical line intersecting a preferred location in the are. The visible indication is not provided if the barrel passes through the imaginary vertical line at less than the acceptable speed. In this way, a visual aid is provided to train a person to focus on the preferred location of the arc until the bat passes through the preferred location.

In still another aspect, a kit includes a handle connected to a barrel in which a channel is formed. A movable magnet is disposed in the channel, and means are provided for urging the movable magnet toward a housed position. The movable magnet can move between the housed position and a swung position when sufficient centrifugal force is imparted to the movable magnet to overcome the means for urging. A wire coil surrounds the channel, with the movable magnet moving through the coil when the movable magnet moves from the housed position to the swung position to induce a temporary electrical signal in the coil as the magnet passes through the coil. At least one light source is mounted on the barrel and is visible to a person swinging the bat. The light source is electrically connected to the coil to emit a flash of light in response to the movable magnet moving rapidly from the housed position to the swung position as a batter swings the barrel. Plural non-magnetic spacers are also provided. A user can dispose one or more of the spacers between the magnets as needed to establish a desired swing speed at which centrifugal force overcomes the magnetic attraction between the magnets when the movable magnet is in the housed position to move the movable magnet toward the swung position.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
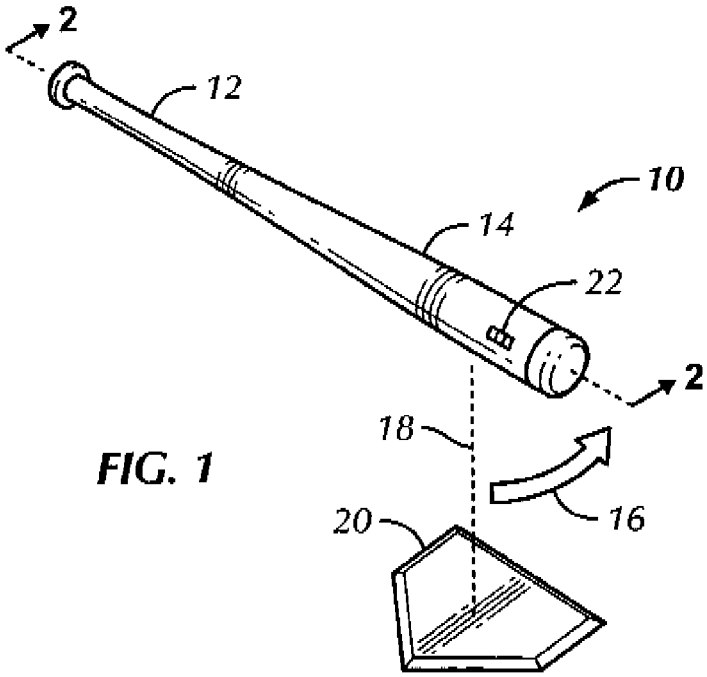
FIG. 1 is a perspective view of the training bat as it would be swung from the right side of a home plate, at the desired location of ball contact in front of a right-handed batter.

Referring initially to FIG. 1, a training bat is shown, generally designated 10, which includes a handle 12 connected to a barrel 14. The bat 10 may be made of wood or metal or composite materials and may be a conventional bat altered in accordance with present principles.

As shown in FIG. 1, visible indication can be provided on the barrel 14 of the barrel 14 being swung in a preferred swing plane described by the arc 16 at or greater than an acceptable speed as it passes through an imaginary vertical line 18 intersecting a preferred location in the arc, typically just in front of a home plate 20 next to which a batter in training typically would stand (FIG. 1 assumes a right-handed swing). The visible indication, however is not provided if the barrel 14 passes through the imaginary vertical line 18 at less than the acceptable speed.

In the embodiment shown in FIG. 1, the visible indication is a flash of light generated by a source of light such as one or more lamps. In the non-limiting embodiment shown, plural light emitting diodes (LED) 22 are mounted on the surface of the barrel 14 for operation to be shortly disclosed.

Figure 2:
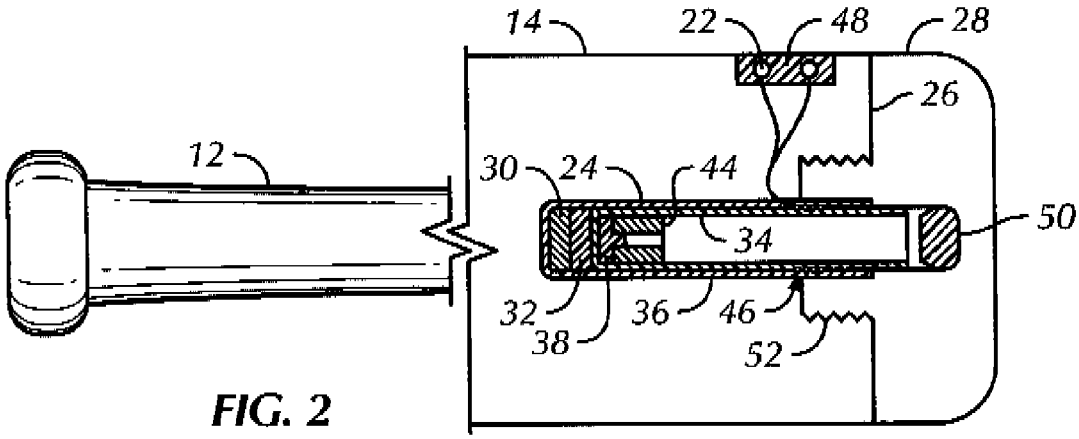
FIG. 2 is a cross-sectional view as would be seen along the line 2-2 in FIG. 1, with the moving magnet in the housed position, with portions of the bat body broken away for clarity.
Figure 3:
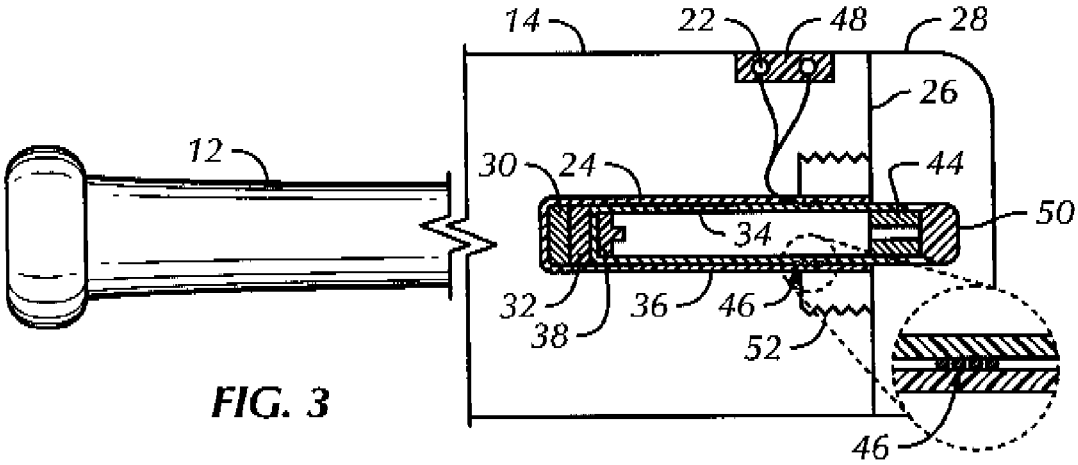
FIG. 3 is a cross-sectional view as seen along the line 2-2 in FIG. 1, with the moving magnet moved by an adequate centrifugal force from the housed position to the swung position, causing it to move through the coil to produce a temporary Faraday electromotive voltage therein to temporarily illuminate the visual indicators, with portions of the bat body broken away for clarity.
Figure 4:
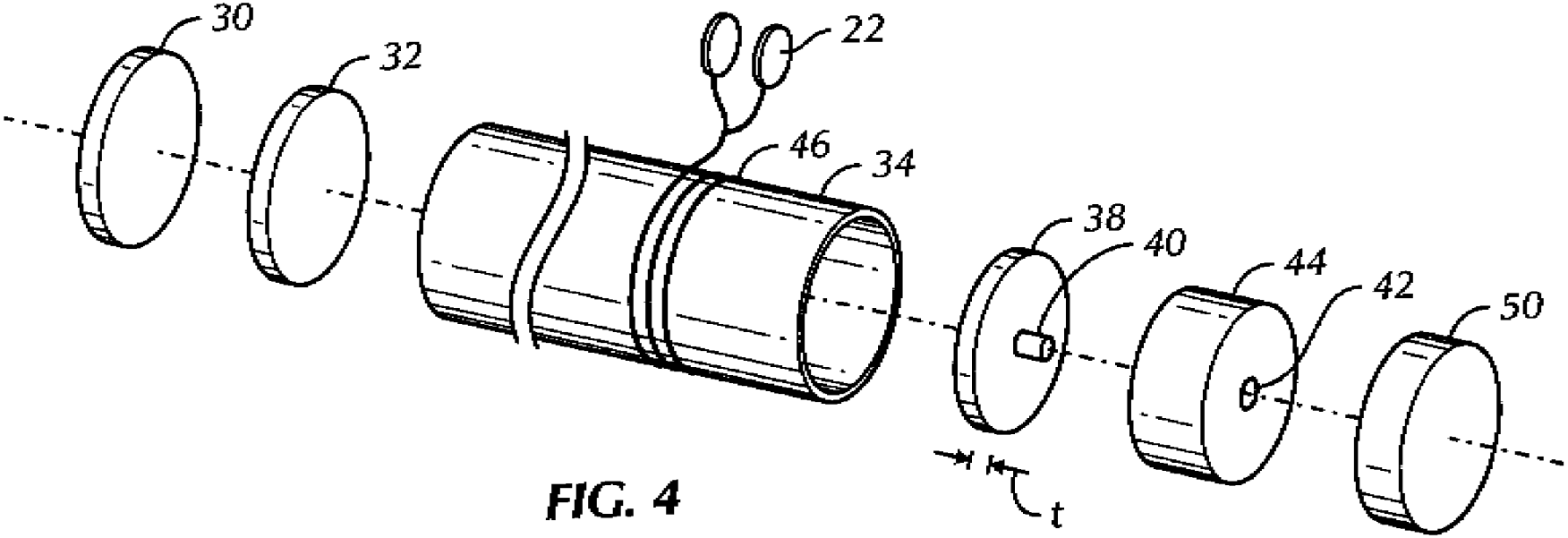
FIG. 4 is an exploded perspective view of the internal components of an embodiment of the bat.

FIGS. 2-4 show non-limiting details of one preferred implementation of the bat 10. Cross-referencing FIGS. 2-4, a channel 24 extends into the barrel 14 from the end 26 of the barrel 14. Preferably, the channel is located coaxially with the long axis of the bat 10. A cap 28 covers the open end of the barrel as shown.

At the closed end of the channel, a disk-shaped stationary magnet 30 is located. If desired, a first disk-shaped spacer 32 may be positioned in the channel to abut the stationary magnet 30. In the non-limiting implementation shown, a hollow, typically plastic tube 34 with a closed end is then advanced into the channel closed end first. To fixedly hold these components within the channel 24, epoxy 36 may be deposited in the channel 24 as shown.

At least one second spacer 38 having a thickness "t" (FIG. 4) is positioned within the tube 34 against its closed end. As perhaps best shown in FIG. 4, the spacer 38 may be centrally formed with a hub 40, and the hub 40 protrudes toward and may be receivable in an interference fit with a channel 42 of an otherwise disk-shaped movable magnet 44. The pole of the movable magnet 44 facing the stationary magnet 30 is the opposite polarity of the pole of the stationary magnet 30 that faces the movable magnet 44, so that the magnets attract. The magnets may be, without limitation, neodymium magnets or iron magnets.

It may now be appreciated that the magnetic attraction between the magnets 30, 44 (aided if desired by the frictional fit between the hub 40 and channel 42 of the movable magnet 44) holds the movable magnet in the housed position shown in FIG. 2. It may be further appreciated that when sufficient centrifugal force is imposed on the movable magnet 44 toward the end of the bat, i.e., when the bat is swung at sufficient speed, the magnetic attraction is overcome and the movable magnet 44 rapidly slides down the tube 34 toward the end of the bat to the swung position shown in FIG. 3. It may be still further appreciated that the separation force needed to move the movable magnet 44 to the swung position depends on the strength of the magnetic attraction in the housed position and, hence, on the thickness "t" of the spacer 38. The thickness "t" thus may be established to establish the bat speed at which the magnet 44 moves to the end of the bat. To this end, several spacers 38 of varying thickness may be provided, and the user can select thicker spacers (and hence lower separation bat speeds) for younger batters and thinner spacers (and hence higher separation bat speeds) for older batters. Or, multiple spacers of the same thickness may be provided, and the user simply inserts as many spacers as are required to achieve the desired separation bat speed. Insertion of the desired spacer or spacers 38 is easily done by removing the cap 28 from the barrel to expose the open end of the tube, removing the movable magnet, inserting into the tube (and/or removing from the tube) spacers 38 as desired, inserting the movable magnet back into the tube, and re-engaging the cap with the barrel.

A wire coil 46 surrounds the tube 34 and is electrically connected to the LEDs 22, which advantageously are mounted in a depression 48 in the surface of the barrel 14 and surrounded by a transparent material such as transparent epoxy. Accordingly, when the magnet 44 passes through the coil 46, an electrical signal is temporarily induced in the coil 46, temporarily energizing the LEDs 22 to cause them to appear to flash briefly. Since no energy need be stored in, e.g., a battery, the bat 10 need contain no source of electrical power apart from the electrical power generated by the movable magnet 44 moving through the coil 46.

Completing the description of FIGS. 2-4, the cap 28 holds a shock absorbing pad 50 that is contacted by the movable magnet 44 when the movable magnet 44 reaches the swung position shown in FIG. 3 to generate audible and tactile feedback signals to a person swinging the bat. As shown, the cap 28 can have male threads 52 that engage a complementarily threaded passage in the barrel 14, or the end of the barrel 14 may be externally threaded to engage an internal female thread structure of an alternate cap 28. Other means including set screws may be provided to hold the cap 28 onto the end of the bat.

With the non-limiting example embodiment described above, development of a short, powerful swing by a batter is facilitated. Specifically, embodiments of the invention help develop muscular coordination for the short swing by only giving positive feedback if the swing has produced the centripetal acceleration necessary to produce the centrifugal force required to release the magnet through the coil. Once bat speed is maximized, momentum carries the bat at that speed through the remainder of the swing. In addition to producing maximum bat speed, the short swing also requires substantially less time to move the bat from the ready position to the hitting zone, giving more time to react to pitch location, and requires less movement to orient the swing plane to the pitch location.

Practicing with the present bat helps train the batter to generate the maximum bat speed of which that batter is capable, and to do so with optimum plate coverage, bat orientation, swing plane, and body position. If any of those factors are absent, the LEDs will not flash in the proper location, or will not flash at all.

While the particular TRAINING BAT WITH VISUAL FEEDBACK OF PROPER SWING is herein shown and described in detail, it is to be understood that the subject matter which is encompassed by the present invention is limited only by the claims. For example, means other than the stationary magnet may be used to urge the movable magnet toward the housed position, including a spring or elastic band affixed at one end to the channel and at the other end to the movable magnet, with or without a latch mechanism to maintain the magnet in the housed position. Or, the stationary magnet can be omitted and a frictional fit between the spacer hub and movable magnet channel exclusively used to hold the magnet in the housed position.

What is claimed is:

1. A baseball training bat comprising:

a handle and a barrel, the barrel having an end distanced from the handle, a channel being formed in the barrel from the end of the barrel and extending toward the handle;

a stationary magnet affixed within the channel;

a movable magnet disposed in the channel for translational movement between a housed position, wherein the movable magnet is adjacent the stationary magnet and wherein magnetic attraction holds the movable magnet in the housed position, and a swung position, toward which the movable magnet moves when sufficient centrifugal force is imparted to the movable magnet to overcome the magnetic attraction between the magnets;

a wire coil surrounding at least a portion of the channel, the movable magnet moving through the coil when the movable magnet moves from the housed position to the swung position to induce a temporary electrical signal in the coil; and at least one light emitting diode (LED) mounted on the barrel and visible to a person swinging the bat, the LED being electrically connected to the coil to emit a flash of light at least in response to the movable magnet moving rapidly through the coil as a batter swings the bat, the bat containing no source of electrical power apart from the electrical power generated by the movable magnet moving through the coil, wherein when the movable magnet passes through the coil, an electrical signal is temporarily induced in the coil, temporarily energizing the LED to cause it to flash.

2. The bat of claim 1, wherein the bat is made of wood.

3. The bat of claim 1, wherein the bat is made of metal or composite materials.

4. The bat of claim 1, comprising plural LEDs on the barrel.

5. The bat of claim 1, wherein the stationary magnet is held in the channel by epoxy.

6. The bat of claim 1, further comprising at least one non-magnetic spacer disposed between the magnets and defining a thickness in the dimension of the long axis of the bat, the thickness being established such that centrifugal force overcomes magnetic attraction between the magnets to move the movable magnet when the bat is swung at least as fast as a desired bat speed.

7. The bat of claim 6, further comprising a tube in the channel and holding at least the movable magnet.

8. The bat of claim 7, wherein the spacer is disposed in the tube.

9. The bat of claim 1, comprising a cap engaged with the end of the barrel, the cap holding a shock absorbing pad contacted by the movable magnet when the movable magnet reaches the swung position to generate audible and tactile feedback signals thereof to a person swinging the bat.

10. A baseball training device comprising:

an elongated barrel swingable in an arc by a person;

visible indication being provided on the barrel of the barrel being swung at or greater than an acceptable speed as it passes through an imaginary vertical line intersecting a preferred location in the arc, the visible indication of the barrel being swung at or greater than the acceptable speed being caused by a movable magnet in the barrel moving through a wire coil in the barrel such that the visible indication of the barrel being swung at or greater than the acceptable speed is always removed from presentation unless the bat is being moved to cause the movable magnet to move through the wire coil, the visible indication not being provided if the barrel passes through the imaginary vertical line at less than the acceptable speed, whereby a visual aid is provided to train a person to focus on the preferred location of the arc until the bat passes through the preferred location wherein the training device contains no source of electrical power apart from the electrical power generated by the movable magnet moving through the coil.

11. The device of claim 10, wherein the visible indication is a flash of light.

12. The device of claim 1, wherein the flash of light is produced by at least one lamp.

13. The device of claim 12, wherein the lamp is a light emitting diode (LED).

14. The device of claim 10, wherein visible indication is provided based on the motion of the movable magnet in the device through the coil supported by the device.

15. The device of Claim 14, wherein the movable magnet is disposed in the barrel for translational movement between a housed position, wherein the movable magnet is relatively close to a bat handle associated with the barrel, and a swung position, toward which the movable magnet moves away from the handle when sufficient centrifugal force is imparted to the movable magnet, the movable magnet moving through the coil as it moves from the housed position to the swung position.

16. The device of claim 15, comprising a stationary magnet affixed within the barrel and attracting the movable magnet toward the housed position.

17. The device of claim 16, further comprising at least one non-magnetic spacer disposed between the magnets and defining a thickness in the dimension of the long axis of the barrel, the thickness being established such that centrifugal force overcomes magnetic attraction between the magnets to move the movable magnet when the bat is swung at least as fast as the acceptable speed.

18. A kit comprising:

a handle connected to a barrel, the barrel having an end distanced from the handle, a channel being formed in the barrel from the end of the barrel and extending toward the handle;

a movable magnet disposed in the channel;

means for urging the movable magnet toward a housed position, wherein the movable magnet can move between the housed position and a swung position when sufficient force is imparted to the movable magnet to overcome the means for urging;

a wire coil surrounding at least a portion of the channel, the movable magnet moving through the coil when the movable magnet moves from the housed position to the swung position to induce a temporary electrical signal in the coil as the magnet passes through the coil;

at least one light source mounted on the barrel and visible to a person swinging the bat, the light source being electrically connected to the coil to emit a flash of light in response to the movable magnet moving through the coil as a batter swings the barrel such that an electrical signal which is temporarily induced in the coil when the movable magnet passes therethrough temporarily energizes the light source to cause it to flash only once and thereafter remain deenergized until the movable magnet subsequently passes through the coil; and plural non-magnetic spacers, wherein a user can dispose one or more of the spacers between the magnets as needed to establish a desired swing speed at which force overcomes the magnetic attraction between the magnets when the movable magnet is in the housed position to move the movable magnet toward the swung position and wherein the kit contains no source of electrical power apart from the electrical power generated by the movable magnet moving through the coil.

19. The kit of claim 18, wherein the means for urging is a stationary magnet affixed within the channel.

* * * * *